US007443995B2

(12) United States Patent
Babb et al.

(10) Patent No.: US 7,443,995 B2
(45) Date of Patent: Oct. 28, 2008

(54) ACOUSTIC LOUDSPEAKER

(75) Inventors: Burton Babb, Dallas, TX (US); Alan Babb, Dallas, TX (US)

(73) Assignee: Babb Laboratories, Dallas, TX (US)

( * ) Notice: Subject to any disclaimer, the term of this patent is extended or adjusted under 35 U.S.C. 154(b) by 246 days.

(21) Appl. No.: 11/060,143

(22) Filed: Feb. 17, 2005

(65) Prior Publication Data

US 2005/0196012 A1 Sep. 8, 2005

Related U.S. Application Data

(63) Continuation of application No. 09/997,416, filed on Oct. 30, 2001, now abandoned.

(60) Provisional application No. 60/288,284, filed on May 2, 2001, provisional application No. 60/244,430, filed on Oct. 30, 2000.

(51) Int. Cl.
*H04R 1/00* (2006.01)

(52) U.S. Cl. ..... 381/396; 381/409; 381/410; 381/412; 381/414

(58) Field of Classification Search ..... 381/396, 381/398, 400, 403, 405, 412, 401, 409, 410, 381/432, 407, 414
See application file for complete search history.

(56) References Cited

U.S. PATENT DOCUMENTS 3,632,904 A 1/1972 Mauz
3,711,659 A * 1/1973 Bremseth ..... 381/410
3,963,882 A * 6/1976 Lewis ..... 29/605
4,289,937 A 9/1981 Ikeda et al.
4,414,437 A 11/1983 Trauernicht et al.
4,466,505 A 8/1984 Ritter
4,473,811 A * 9/1984 Schauble ..... 336/171
4,568,845 A * 2/1986 Uehara ..... 310/13
4,590,332 A 5/1986 Delbuck
4,897,877 A 1/1990 Telzlaff
5,027,412 A 6/1991 Hayashi et al.
5,381,483 A 1/1995 Grau
5,701,359 A 12/1997 Guenther et al.
5,940,522 A 8/1999 Cahill et al.
6,111,969 A 8/2000 Babb
6,421,449 B1 * 7/2002 Hasegawa et al. ..... 381/401

* cited by examiner

*Primary Examiner*—Wayne Young
*Assistant Examiner*—Dionne H Pendleton
(74) *Attorney, Agent, or Firm*—Gardere Wynne Sewell LLP

(57) ABSTRACT

An acoustic driver has a voice coil in which adjacent turns of the coil are spaced apart. The driver is placed at one end of a foam-lined, elongated structure, such as a tube. An opposing end of the structure is, in one embodiment, enclosed by a wall that is connected to the structure by a suspension so that it moves in sympathy with the driver. In another embodiment, the structure cooperates with the acoustic driver to form one or more restrictive passageways confined around the driver's motor and an inner surface of the structure. The passageway (s) couple a volume of air in the structure to the exterior of the structure in a manner that reduces the transmission of acoustic energy without creating alternating pressure within the structure that interferes with the movement of the voice coil's diaphragm, at its maximum points of excursion.

14 Claims, 8 Drawing Sheets

ACOUSTIC LOUDSPEAKER

RELATED APPLICATIONS

This application is a continuation application of U.S. Ser. No. 09/997,416 entitled "Acoustic Loudspeaker," filed Oct. 30, 2001 now abandoned which is related to provisional patent application No. 60/288,284 entitled, "Acoustic Loudspeaker" filed May 2, 2001 and provisional application No. 60/244,430 entitled, "Acoustic Loudspeaker" filed Oct. 30, 2000, from which priority is claimed.

FIELD OF THE INVENTION

The invention relates, in general, to acoustic loudspeakers.

BACKGROUND OF THE INVENTION

To provide the greatest listening pleasure, an acoustic loudspeaker must meet several basic requirements. First, a loudspeaker must accurately reproduce very low frequencies, such as bass notes below 40 Hz, which are felt more than heard by most listeners. Second, loudspeakers must accurately reproduce overtones of high frequencies. Third, a loudspeaker should have a relatively flat frequency and phase response over the full range of audible frequencies, i.e., from approximately 30 Hz to 20,000 Hz, in order to produce high-fidelity sound. Fourth, to provide a wide dynamic range, a loudspeaker must handle signals with power sufficient to reproduce low frequencies at loud volumes without distortion to the sound or damage to the speaker.

In addition to the ideal frequency and phase response characteristics of a loudspeaker, a system of multiple loudspeakers should recreate whatever spatial illusions are contained in the source material. For example, most music sources are encoded for stereo reproduction using two channels. Two, spatially-separated and phase-synchronous infinitesimal point sources of acoustic energy theoretically provide the best stereo imaging, because such point sources can create the illusion of sound originating from any point along a line extending through both point sources. Therefore, a loudspeaker system should imitate as closely as possible two infinitesimally small point sources of acoustic energy.

A conventional acoustic transducer has a relatively stiff or rigid diaphragm which reciprocates along a linear axis. For reproducing low frequencies, the diaphragm has preferably a concave, cone shape. For high frequencies, it may be flat or convex. To vibrate the diaphragm, an electrical signal representing the sound wave to be reproduced flows through a coil mechanically connected to the diaphragm. The coil is situated within a fixed magnetic field, causing the coil to reciprocate with changes in the current. The coil is formed from one or more lengths of wire wrapped around a support structure. Typically, the edges of the diaphragm are attached to a basket shaped frame using a compliant, slightly resilient, material. The coil is centered within a gap referred to as a "flux gap," formed between a cylindrically shaped pole and a donut-shaped magnet assembly.

To provide the most accurate sound reproduction, the movement of the coil in response to the electrical signal and the coupling of the movement of the diaphragm to the air in response to the movement of the coil must be linear. Unfortunately, the responses of these elements to the sound signal are rarely totally linear, especially over the entire audible range. The diaphragm couples the mechanical energy of the moving coil to the air, thereby causing the air to vibrate and setting up acoustic waves. At lower frequencies, the diaphragm can be thought of as behaving like a simple mechanical piston pushing volumes of air. At low frequencies, a lot of power is required to push large volumes of air, particularly at loud volumes. Therefore, to sound low notes with great volume a speaker must be capable of handling a lot of power, mechanical stresses from the strong electromagnetic forces and resulting heat.

For good low frequency response, a driver is needed which is mechanically strong and powerful in order to move larger amounts of air. Thus, a stiffer diaphragm with a large surface area is preferred. However, a large, stiff diaphragm means more structure, and thus more mass. More mass means less efficiency, and thus more power to reproduce the same loudness. More power means that a more massive coil is required to handle the mechanical and thermal stresses resulting from the power. However, more mass in the moving parts inhibits the driver's ability to reciprocate at higher frequencies. Also, it is more difficult to control coupling of the movement of the coil to the air through a large diaphragm and its natural resonances. A smaller diaphragm could be used to sound bass notes, but a longer throw or stroke of the coil would be required to move the same amount of air. However, a longer stroke necessitates either a magnetic field of greater magnitude or a longer coil in order to provide a sufficiently high electromotive force (EMF). Furthermore, a greater coil length means greater induction. Thus, the length of the coil is limited. A long stroke also requires the coil to move at a higher velocity. Higher velocities will create a higher back EMF, which resists travel of the coil and ultimately limits the ability of the driver to reproduce low frequencies.

Attempts have been made to accommodate the demands of high and low frequencies in a single, broad band acoustic driver, particularly in the area of reducing the mass of the moving parts of the driver. For example, as shown in U.S. Pat. Nos. 4,115,667 and 4,188,711 of Babb, the conventional rear suspension for the coil is replaced with a low friction bearing made of TEFLON®. The bearing is formed at the bottom of the coil, opposite of where it connects to the diaphragm, and encircles and rides on the post. The coil remains centered within the gap without the extra mass of the rear suspension and its spring forces interfering with movement of the coil. The coil therefore can move more freely and accelerate faster, which aids in moving the coil long distances when using a longer throw coil to sound bass notes. A low friction bearing can also be added around the circumference of the top end of the post. Lightweight, stiff metal alloys have been used to form diaphragms. Coil forms (structures for supporting windings of coils) have been made from high strength, thermally resistant materials such as KAPTON®. To provide a low mass, compliant suspension for the diaphragm, a stamped synthetic foam having a very low density with good dampening and resonance characteristics is used.

However, a coil undergoes great mechanical stress from the EMF generated by the magnet and the current running through the coil, as well as great thermal stress from the substantial heat generated when large currents flow through the coil during reproduction of loud notes. Despite the use of lightweight, stiff materials, a low mass coil capable of sounding both high and low frequencies will naturally tend to be weaker and thus more easily deformed by the mechanical and thermal stresses present during reproduction of high power sounds. A low mass coil also cannot store heat for later dissipation. Thus, during extended periods of loud notes, a low mass coil will tend to get very hot and possibly damaged. Furthermore, TEFLON® is not structurally strong and tends to shrink in heat, thus resulting in increased drag of the coil's bearing on the post and deformation under high thermal and mechanical loads. A deformed coil cannot sound notes as accurately and will tend to rub against the walls defining the flux gap, causing noticeable distortion of low notes and extraneous noise at midrange frequencies.

SUMMARY OF THE INVENTION

The invention is directed to an improved loudspeaker that overcomes one or more problems with previous loudspeakers, particularly those used for broadband sound reproduction. In particular, it has as an objective a loudspeaker that has one or more of the following comparative advantages: higher efficiency, lower power consumption, better power handling capability, greater range and flatter frequency response.

The specific advantages of the invention will be described or apparent from the following description of a representative loudspeaker system embodying the invention, made with reference to the appended drawings.

DETAILED DESCRIPTION

U.S. Pat. No. 6,111,969 issued Aug. 29, 2000, and U.S. Pending application Ser. No. 09/397,191 filed Sep. 16, 1999 and U.S. Ser. No. 09/790,223 filed Feb. 21, 2001 are incorporated herein by reference. In the following description, like numbers refer to like elements.

Figure 1:
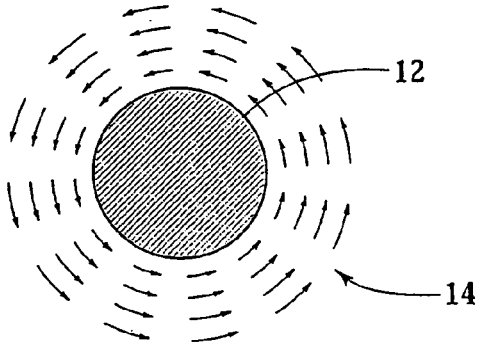
Fig.1 (PRIOR ART)
FIG. 1 is a cross section of a prior art wire conducting a current and generating a magnetic field.

Referring to prior art FIG. 1, current flowing through a conductor, for example a metal wire 12, creates a circular magnetic field represented by flux lines 14. For a wire conductor, the magnetic field intensity depends on the relationship of $$H=i/(2\pi r)$$

wherein H is the magnetic field intensity, i is electrical current flowing through the conductor, and r is the radius from the center of the wire.

Figure 2:
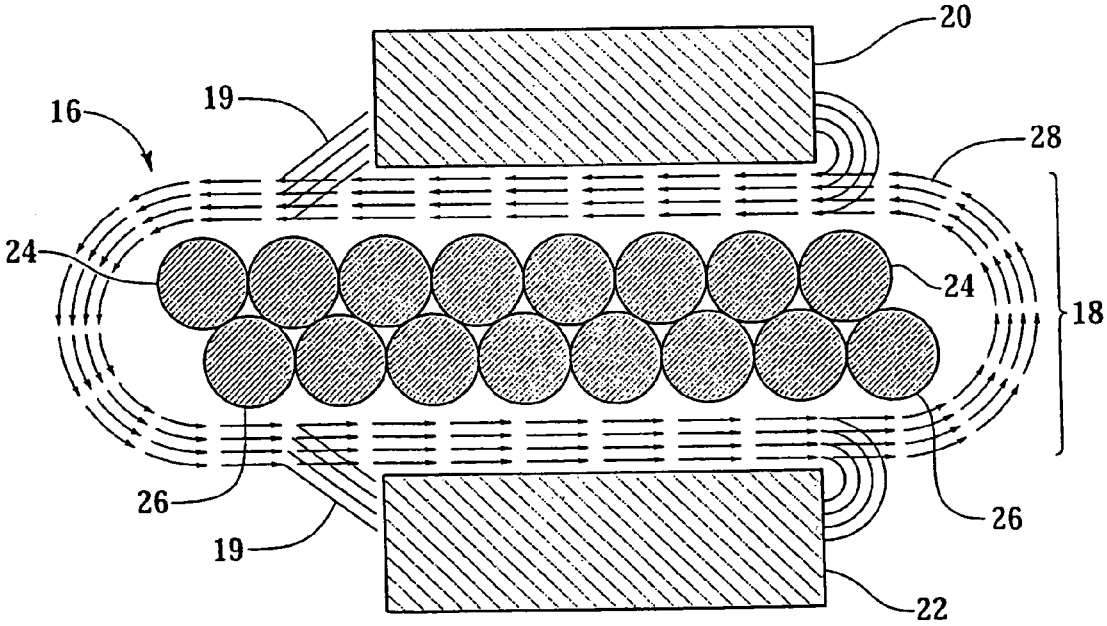
Fig.2 (PRIOR ART)
FIG. 2 is a representation of the magnetic fields associated with a current passing through a coil, which is shown in a section of one side of the coil, within a fixed magnetic flux gap.
Figure 3:
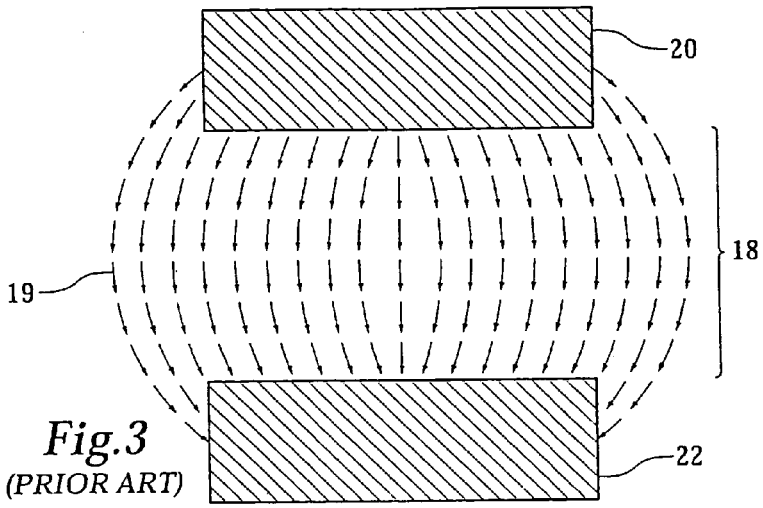
Fig.3 (PRIOR ART)
FIG. 3 is a representation of magnetic fields within the flux gap of FIG. 2 without the coil.

Referring now to prior art FIG. 2, which is a schematic illustration of a cross-section of representative loudspeaker, a portion of a coil 16 is disposed within a flux gap 18 across which a fixed magnet field generated by a magnetic gap defined by iron pole 20 and iron pole 22 extends. As best seen in FIG. 3, flux lines 19 of the fixed magnetic field are, in the absence of the coil, generally straight across the flux gap. A typical prior art coil for a loudspeaker includes at least one wire wound back and forth one or more times so that it has either 2 or 4 layers of insulated wire that are closely wound so that adjacent turns abut each other. In the example of FIG. 2, coil 16 has two layers 24 and 26 of insulated wire(s) wound around a cylindrical support structure, which is not shown. This structure can take the form of a lightweight material, such as KAPTON®. The insulation layer is not visible in the illustrated cross sections. Each wire carries the same current signal. By closely spacing the turns of the coil and using multiple layers of wire(s), more turns of the coil are located within the flux gap's fixed magnetic field.

Figure 4:
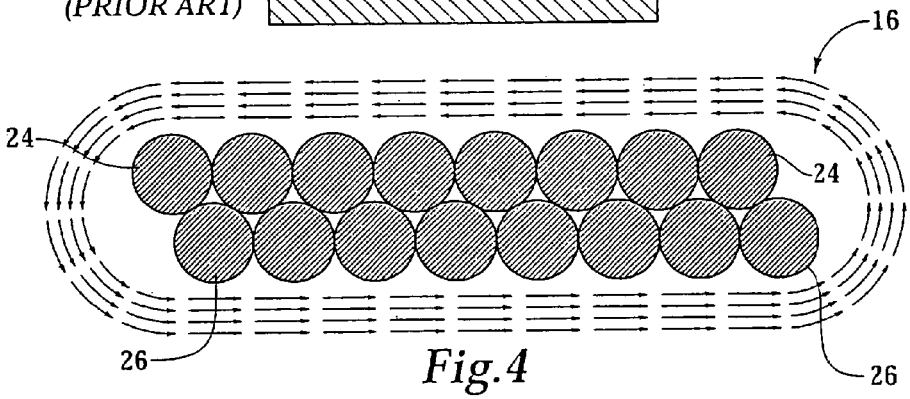
Fig.4 (PRIOR ART)
FIG. 4 is a representation of the magnetic field of the prior art coil of FIG. 2, outside the flux gap.

Referring briefly to prior art FIG. 4, which is a representation of a cross section of a portion of the coil 16 outside the flux gap 18, the magnetic field resulting when a current flows through the coil is represented by flux lines 16. The resulting field, which is a vector addition of the field produced by each turn of the coiled wire layers 24 and 26, is predominately in directions perpendicular to the fixed magnetic field within the flux gap. A major portion of the field generated by each turn tends to be cancelled by an opposite field of its immediately adjacent neighbor.

Figure 5:
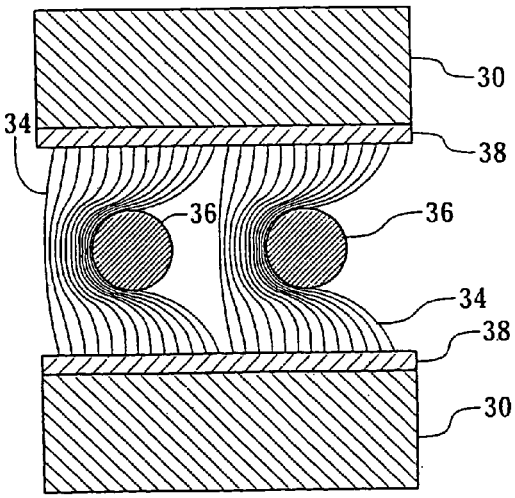
FIG. 5 is a representation of adjacent turns of a spaced wire coil, taken in cross-section, disposed within a fixed magnetic flux, illustrating the effect on the magnetic flux density associated with current passing through the coil.

The repulsion force generated by the interaction of two magnetic fields is proportional to $\phi_1\phi_2 \cos\theta$, where $\phi_1$ is the magnetic flux of the first field, $\phi_2$ is the magnetic flux of the second field, and $\theta$ is the relative angle between the two. Thus, the greatest force is generated by fields that are parallel, rather than perpendicular, to one another. As illustrated by FIG. 5, spacing the wires apart from one another results in less cancellation of the magnetic flux in the directions parallel to the fixed magnetic field, thus increasing the force that is generated as compared to that of a conventional coil.

Referring to FIG. 5, a driver of a loudspeaker system preferably includes a coil with spaced-apart turns. In such a driver, a fixed magnetic field gap is created by plates 30 and 32. Flux lines 34 represent this field, and the spacing of the lines the flux density. A current passing through adjacent turns of a coil of wire 36 creates around each turn a circular magnetic field that causes the density of the flux 34 of the fixed magnetic field to increase on the side of the wire that has a current induced magnetic field in the same direction. With the increase in flux density, a force is generated on one side of each turn. More force can be generated with fewer turns, as compared to the prior art coil in which the increase in flux density takes place predominately at one end of the coil. The spacing is preferably approximately equal to the diameter of the wire, but may range from substantially 75% to 150% of the wire's diameter. The coil wire may be either round, as illustrated, or rectangular. Rectangular wire with the long side oriented radially from the coil is a preferred embodiment but it presents the most manufacturing difficulties.

Thus, contrary to traditional teachings for an efficient loudspeaker "motor" or transducer, such a coil has better magnetic coupling. With better magnetic coupling and less resistance due to the relatively shorter length of wire used, it is more efficient at converting electrical to acoustic energy and has less mass for a given length than conventional prior art coils. With less mass, it is also comparatively faster. With fewer turns of the wire moving through flux gap, there is less back-EMF generated by the movement of the coil. Since the back-EMF is generated at the point at which the coil is moving the fastest and the current in the coil has dropped to zero, longer linear movement and thus greater bandwidth is possible. Furthermore, with reduced mass and greater coupling efficiency, some of the extra mass can be utilized to support a longer coil, which permits longer linear travel. A longer coil helps to extend bass response. The greater efficiency results in less power being consumed, and thus less heating. The spaced apart turns of the coil also allow for faster heat dissipation. Thus, greater power handling is possible.

Conductive metal plates 38 have the effect of blocking the alternating magnetic fields generated by the coiled wire 36 while permitting the passage of non-alternating magnetic fields. Thus, the plates can be used to compress the circular magnetic fields generated by the current in the wire by not allowing the fields to extend beyond the plates.

Figure 6:
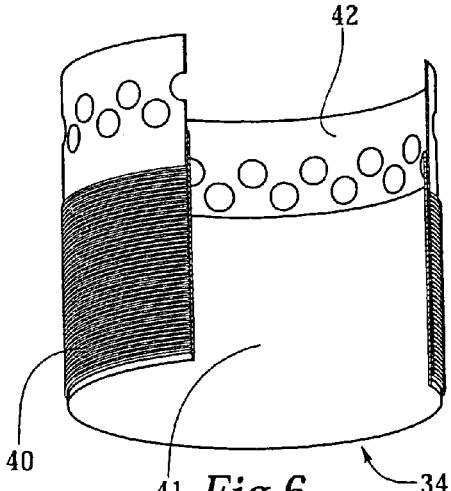
FIG. 6 is a partially sectioned, perspective view of a spaced wire coil.

Referring now to FIG. 6, illustrated is a representative example of a coil 39 with each turn of wire 40 being spaced from adjacent turns by approximately the diameter of the wire. Coil wire 40 is wrapped around a cylindrical support structure 41. This structure is preferably made from a lightweight and thermally stable (does not radically change shape, size, or strength under high heat conditions) material, such as KAPTON®. The coil support structure may be connected to a relatively stiff but lightweight extension collar 42, that in turn is connected to a diaphragm. The holes in the collar permit air flow and reduce mass.

Figure 7:
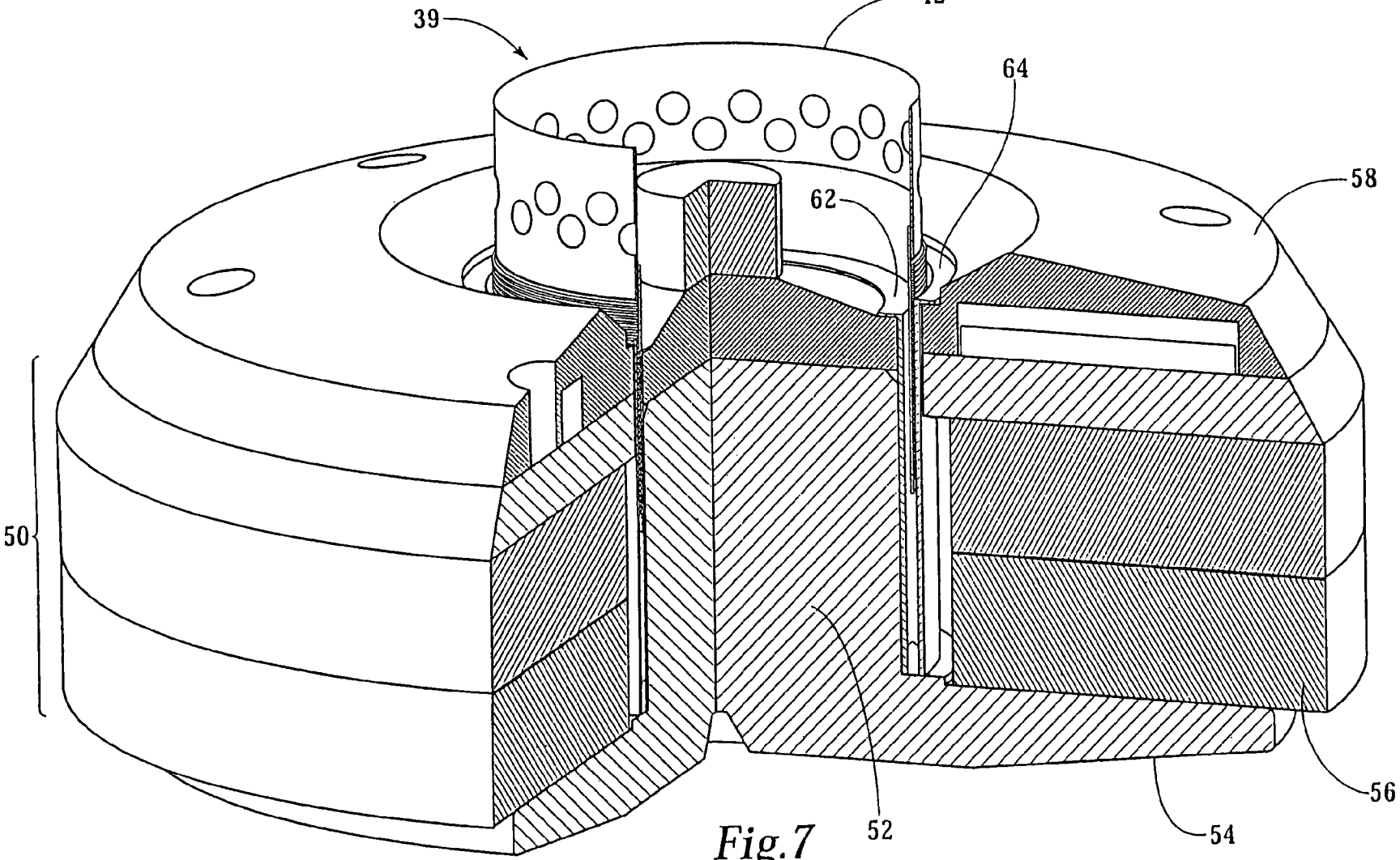
FIG. 7 is a partially sectioned, perspective view of a "motor" or fixed magnet assembly for a driver of a loudspeaker system, including the coil of FIG. 6.
Figure 8:
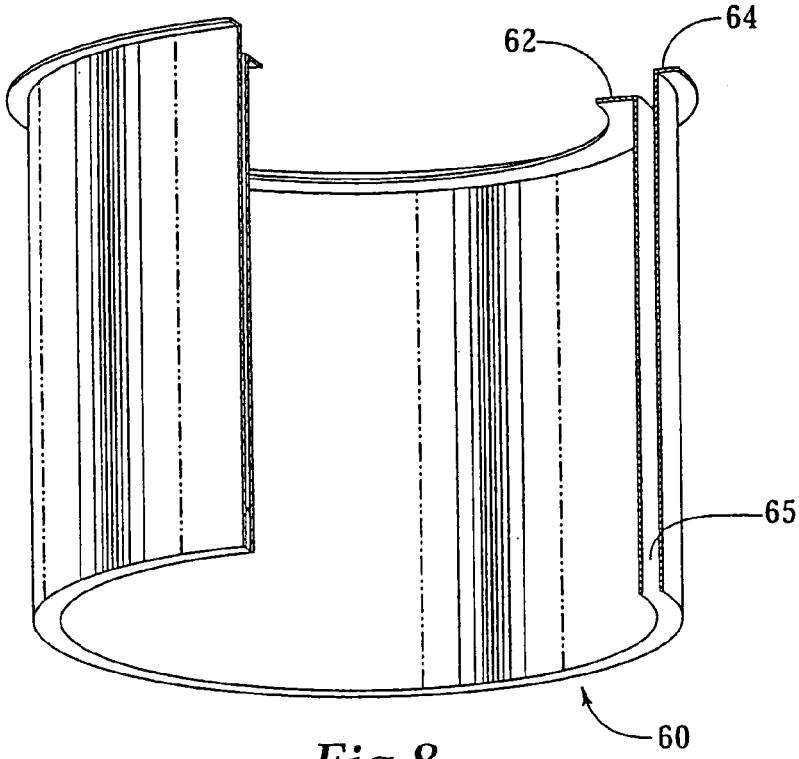
FIG. 8 is a partially sectioned, perspective view of a heat transfer tube assembly that is disposed within a flux gap of the magnet assembly of FIG. 7.
Figure 9:
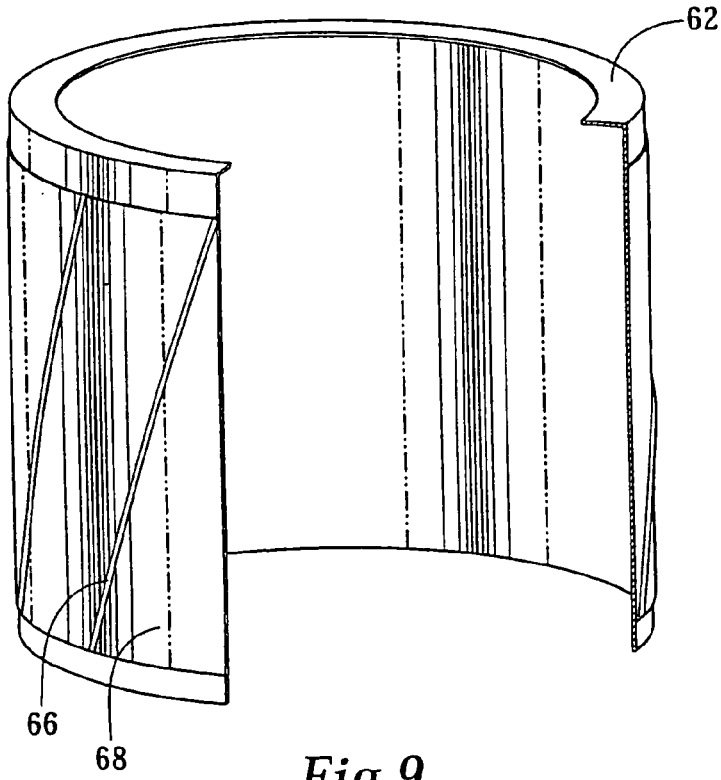
FIG. 9 is a partially sectioned, perspective view of an inner tube of the heat transfer tube assembly of FIG. 8.

Referring to FIG. 7, a "motor" structure 48 for an exemplary embodiment of a loudspeaker system includes a fixed magnet assembly 50. The magnet assembly 50 includes a round, fixed magnet 56 sandwiched between a circular top metal plate 58 and a bottom circular plate 54. The magnet and top plates have center bores through which a pole 52 extends. Between the pole and the top plate 58 is defined a cylindrical opening that forms a flux gap. Within the flux gap is disposed a spaced-apart pair of conductive metal tubes 60. Referring briefly also to FIG. 8, the tubes 60 are comprised of an inner tube 62 and an outer tube 64. The inner tube fits closely to the pole 52. The tubes may be joined at a bottom end by a conductive metal ring 65. The tubes create a gap in which the coil 39 travels. The tubes assist with transferring heat out of the flux gap and away from the coil to lower power compression and to increase power handling. The metal tubes tend to cancel the coil's self-induction and thus improve both the loudspeaker's high and low frequency response by shielding or limiting flux paths. Furthermore, as previously mentioned in connection with FIG. 5, they also limit the size of the field generated by the alternating current in the coil, and thus reduce the effect on each other of neighboring wires within the coil. As shown in FIG. 9, formed on the outer surface of the inner tube are low friction ridges 66. These ridges may be formed, for example, by wrapping a band of low friction tape 68 over compressible thread or similar elongated structure.

Figure 10:
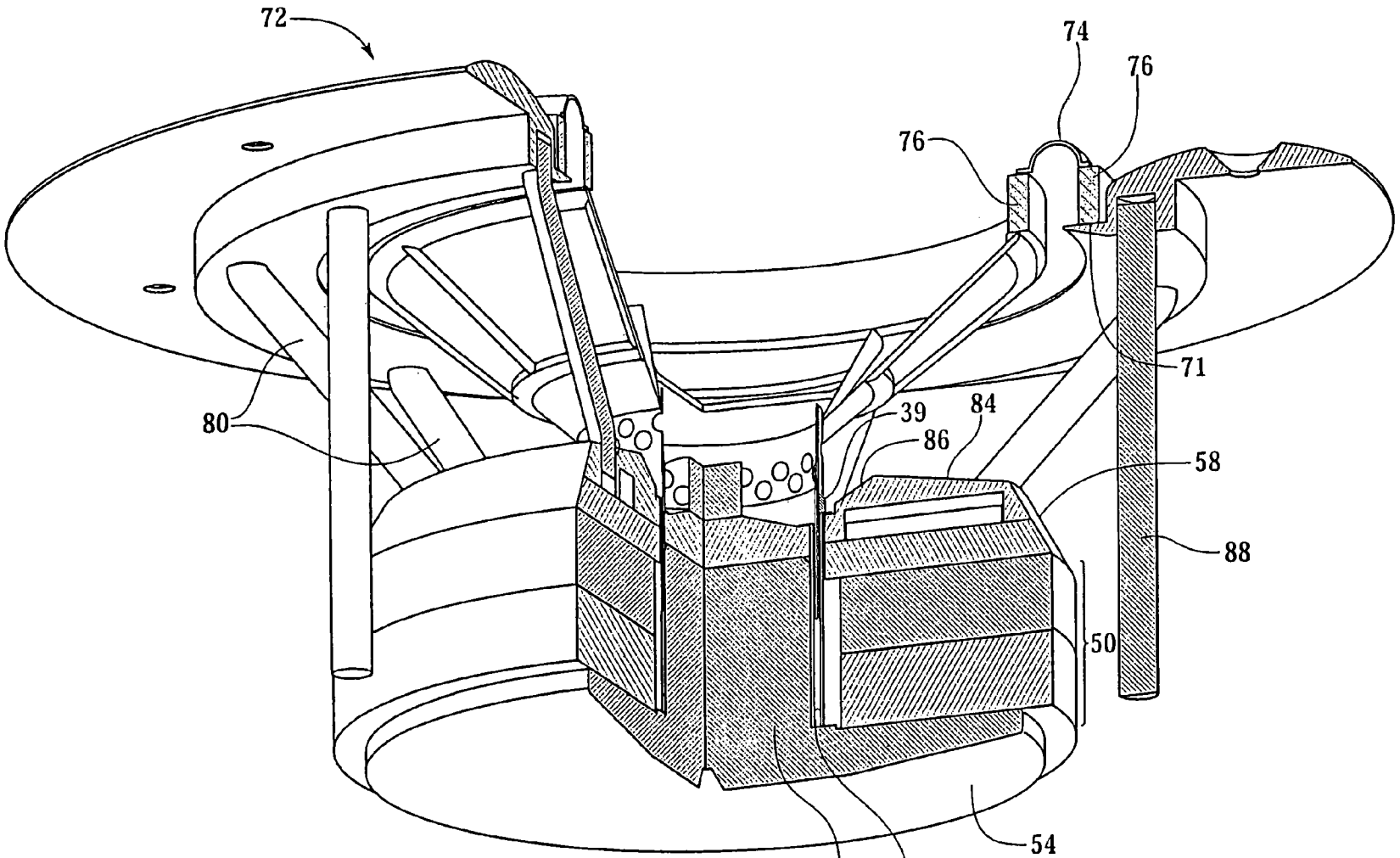
FIG. 10 is a partially sectioned, perspective view of a driver assembly for a loudspeaker system including the tube assembly of FIG. 8 and FIG. 9.
Figure 11:
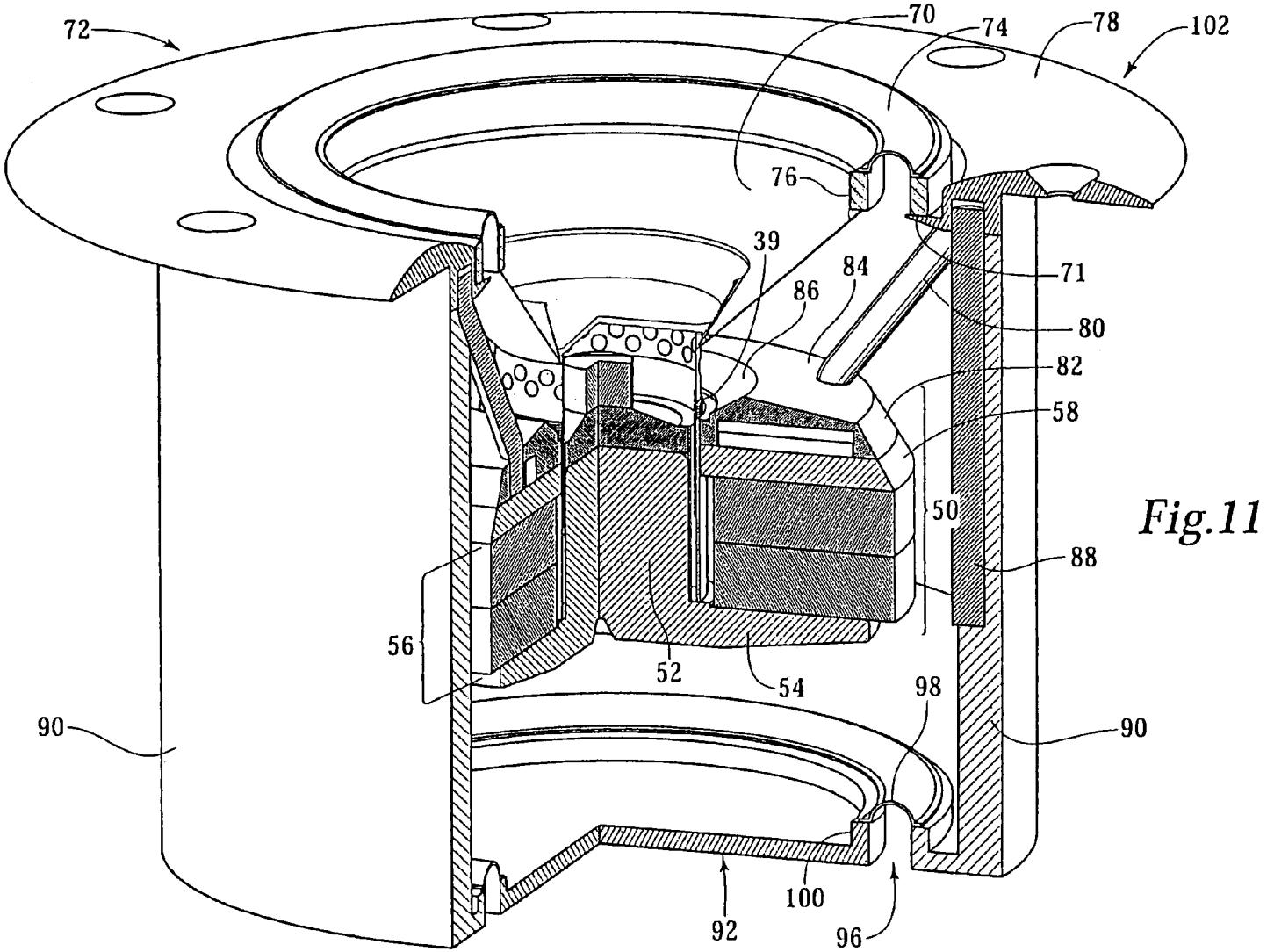
FIG. 11 is a partially sectioned, perspective view of a loudspeaker speaker system including the driver assembly of FIG. 10.

Referring to FIGS. 10 and 11, connected to coil 39 is a cone-shaped diaphragm 70. The diaphragm is suspended from an edge 71 of basket assembly 72 by means of a circular foam assembly that includes a compliant role 74 and two compliant foam riser elements 76. The basket also includes a wide mounting flange 78. The forward face of the mounting flange 78 is gently curved to minimize the effects of edge diffraction. The gap between the edge of the diaphragm and the basket is preferably relatively narrow. To provide a greater range of travel for the diaphragm relative to the basket, each side of the role is attached to a ring-shaped riser of compressible, bendable and stretchable foam. The relatively thin foam tends to impede transmission of sound energy. The narrow gap and riser rings therefore tend to reduce the amount of sound that is transmitted by the backside of the diaphragm and reflected back through the suspension, which, as compared to the diaphragm, tends not to block sound. Such reflected sound tends to degrade the loudspeaker's imaging. To further reduce the amount of reflected sound, the structure of the basket that connects the mounting flange of the speaker to the magnet assembly has predominately round angled surfaces that do not have a direct reflection path back through the diaphragm or its suspension. For example, the mounting flange is connected by a series of round posts 80 arrayed around the speaker, extending from a plate 82 that attaches to the top plate 58 of the magnet assembly. The top surface of plate 82 includes angled surfaces 84 and 86 that have an orientation that tends to reflect sound outwardly and into a energy absorbing tube. Posts 88 are used to support the energy absorbing tube 90. Preferably, the basket is comprised of a material, such as aluminum, that is a good heat conductor. Plate 82 of the basket thermally contact metal tubes 60. Thus, heat generated by the coil 39 within the metal tubes is transferred to the basket. The basket will conduct the heat generated by the coil out to the mounting flange of the speaker, which is located on the outside of the speaker enclosure and may be coupled with a heat conductive grill to protect the driver. The air pumping motion of the cone will pump air through the grill to enhance cooling, thus dissipating the heat generated by the coil into the listening environment.

As best seen in FIG. 11, the backside of the loudspeaker driver is set in one end of energy absorbing tube 90. The energy absorbing tube may be comprised of an outer tube that is made from a high mass but flexible material such as 1/16 inch lead sheet or from a low mass high stiffness material such as 1/4 inch paper tube. Inside the outer tube is laminated a piece of tubular-shaped compressed foam. The inner tube absorbs mid-bass and high frequency sound energy and does not effect low frequency sound energy given off by the rear of the driver. A high mass flexible outer tube has a mass per unit area and stiffness so as to resonate at the upper end of the low frequency range. This resonance can then be used to fill in and smooth the overall bass response of the assembly. If this resonance is not needed, use of a low mass, high stiffness outer tube maximizes deep bass response by absorbing very little low frequency energy and thus couples the driver in the most efficient manner to plate 92. Disposed in the end of the tube opposite the loudspeaker is a passive structure 92 that is closely coupled to the low frequency movements of the diaphragm of the driver. As such, it functions similarly to a "limp wall" that hangs under the force of gravity, the mass of which can be swung back and forth. The structure includes a relatively stiff plate, having approximately the same weight as the diaphragm, that moves back and forth in sympathy with low frequency energy from the driver. The plate is centered and supported by a compliant suspension 96. The suspension preferably has a relatively long travel, permitted by use of a foam role 98 mounted on a set of tall, compliant foam risers 100. The plate 92 acts to greatly enhance and extend low frequency performance. Because it moves in sympathy with the low frequency waves, it transmits low frequency acoustic waves into an enclosure (not illustrated) in which the loudspeaker system is set. However, due to the material from which it is constructed and its physical size, it tends not to move or to vibrate in sympathy with mid to high frequency waves. Rather, it is preferably lined with a foam material that tends to absorb such acoustic waves. A passive structure of this design will function effectively regardless of the orientation of loudspeaker system 102. Some amount of air is permitted to flow through a small opening(s) located in either the tube wall or in plate 92. The size of this opening and the mass of plate 92 can be adjusted to change the "Q"—the bandwidth and frequency of resonance—of the combination of the diaphragm, the energy absorbing tube, and plate 92.

One advantage of the forgoing combination of structures in loudspeaker system 102 is that a single driver can be used to achieve a flat and deep bass response. Furthermore, its frequency response is relatively independent of the air volume of the enclosure that it is placed in. This allows the driver to be tuned precisely at the factory with little regard to the size or type of enclosure in which it is mounted. However, these advantages may also be achieved, but to a lesser degree, by using certain of these features of the illustrated structure alone or in combination with the other features.

FIGS. 12-16 illustrate two examples of another loudspeaker assembly for mounting in a speaker box or other enclosure such as a wall or a door or rear deck of an automobile. The assembly includes an acoustic driver and sound enhancement structure in which the acoustic driver is mounted. The driver and the sound enhancement structure define a confined volume of air that is preferably relatively small, between a diaphragm and a magnet assembly or motor of the acoustic driver. Acoustic frequency energy within this confined volume is coupled to the air outside of the structure through one or more restrictive passageways. The passageway or passageways, working with the confined volume, act to attenuate or interfere with the propagation of acoustic waves emanating from the back of the acoustic driver without storing alternating pressure within the confined volume of air that would adversely affect movement of the diaphragm. The result is that the nature of the enclosure in which the assembly is mounted has much less effect on the performance of the speaker. Furthermore, the sound enhancing structure of the loudspeaker assembly, in the particular embodiment shown and described below, has been found to increase efficiency, extend bandwidth at lower frequencies, and flatten frequency response of the acoustic driver, as compared to the same acoustic driver, particularly when an acoustic driver of the type shown and described in the forgoing figures is employed.

The structure seems to result in less pressure being applied on the acoustic driver's diaphragm at times that would interfere with its low frequency movement, particularly at those instances of time when the cone is at its maximum excursion. Less pressure means that the diaphragm and other components of the driver can be less massive, while still providing a desirable bass response. Less massive components provide greater sensitivity and allow for greater velocity and store less energy storage when moving. Thus, it is possible to have a lighter driver structure that is capable of reproducing low frequency sounds, but without mass-related inertial effects and resonance. The lighter structures also lead to improved transient response of the driver.

Furthermore, an enclosure in which the loudspeaker assembly is mounted has less effect on the performance of an acoustic driver than when just the driver is mounted. The sound enhancing structure can thus be used to tune the acoustic driver for best performance without as much concern for where it is ultimately installed. Furthermore, it also results in less pressure being generated in a box or other sealed enclosure in which the loudspeaker assembly is mounted, thus reducing or eliminating the need for heavy walls and bracing. More economical speaker assembly boxes may be used without a loss, or with a reduction of loss of bass response and overall sound quality. The increased bass response produced by implementation of the invention enables single driver loudspeaker systems and thus eliminates the need for crossovers and the performance limitations associated therewith, such as phase shifts and other anomalies associated with crossovers. Indeed, low frequency response may still be adequate for at least some applications without a sealed enclosure. Additionally, for given efficiency and low frequency cutoff, the volume of air in a sealed enclosure may be reduced with minimum adverse effect.

Furthermore, one conventional performance limit of enclosed speakers is the limit on low frequency performance versus efficiency, which is set by enclosure air volume. This limit results from the storing of low frequency audio energy as alternating air pressure in the enclosure. The loudspeaker assembly solves imaging and clarity problems caused by the interaction of conventional speakers with enclosures. Conventional sealed enclosure loudspeakers have phase shifts at low frequencies which vary as a function of frequency. Therefore, the overtones of bass notes are not in proper phase relationship with the fundamental. This prevents proper imaging. With this loudspeaker assembly, phase shifts are reduced. As a result, bass notes have clarity comparable to midrange notes and image properly. Imaging and clarity problems at all acoustic frequencies are also caused by reaction force acceleration of the magnet structure transmitted by a support structure for an acoustic driver, which is called a basket, to the wall or surface in which the speaker is mounted. This wall or surface acts as a sounding board to amplify vibrations in the support structure of the acoustic driver and make them audible.

The midrange and high frequency energy from the rear of the cone of a conventional speaker design are also very difficult and expensive to control. In preferred embodiments, the structure of this loudspeaker assembly tends to reduce the energy reflected off the structure and toward the diaphragm's suspension by orienting surfaces, such as the top of the driver's magnet assembly, in such a manner to reduce direct reflections back toward the acoustic driver's diaphragm and by lining surfaces with acoustic-energy-absorbing material that dampens resonances. Thus, the acoustic driver's suspension can also be made more compliant without introducing audible leakage of acoustic energy through the suspension. The energy level in the acoustic waves in the mid to high frequencies is adequately reduced or attenuated so that the walls or panels of the enclosure in which the loudspeaker assembly is mounted will not tend to resonate. Furthermore, any signal by the enclosure in which the assembly is mounted tends not to be able to travel back through the passageways and effect the motion of the diaphragm of the driver.

The illustrated examples utilize structures having generally tubular shapes. However, the benefits of the structure are not necessarily limited to one which is strictly tubular in shape, though such a shape has advantages. A driver is mounted in an open end of the structure. The structure thereby defines internal void or volume between the driver's magnet assembly or motor and back side of its diaphragm. At the opposite end of the tubular structure are one or more exit passageways that have length and a cumulative effective cross-sectional area less than that of the effective cross-sectional area of the diaphragm. The passageway's exit opening is generally away from the front of the driver. The passageway is, in the exemplary embodiments, formed at least in part by an annular gap located or defined between the tubular structure and the driver's motor or magnet assembly, or other structure surrounding the motor or magnet assembly. The gap generally extends from the top of the magnet assembly to the bottom of the magnet assembly. The gap can be a single passageway or can be a plurality of separately defined passageways. The dimensions of the one or more passageways may be chosen to tune or result in a desired performance characteristic for the loudspeaker assembly and/or to suit a particular acoustic driver.

Figure 12:
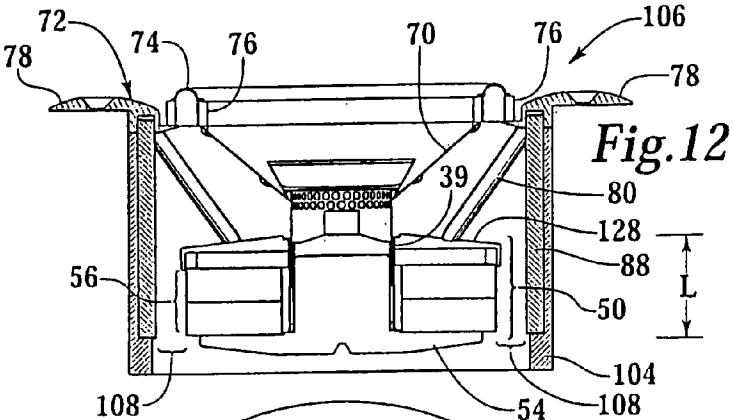
FIGS. 12 and 13 are respectively a front sectional and a bottom view of a loudspeaker system having a first example of an acoustic driver mounted within a sound enhancing structure.
Figure 13:
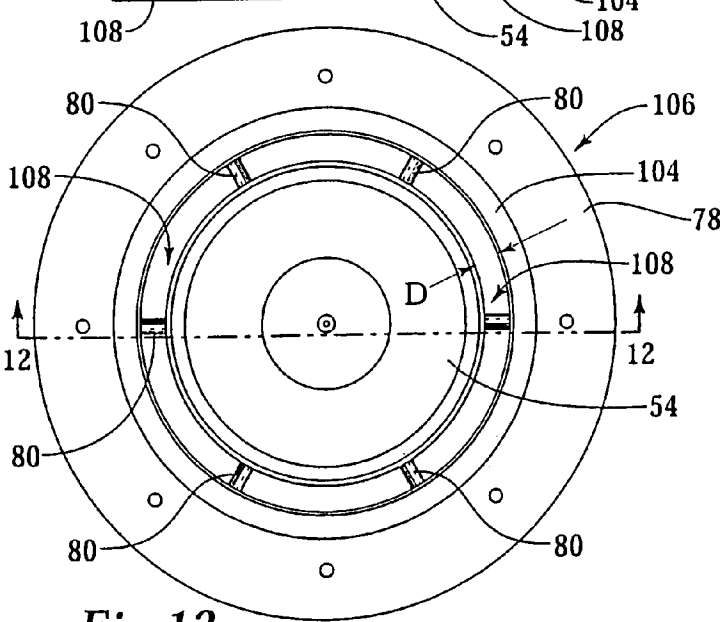

Referring to FIGS. 12 and 13, a first exemplary embodiment of a loudspeaker assembly 106 has a tube 104 similar to the energy absorbing tube 90 of FIG. 11. The tube acts, in conjunction with an acoustic driver, as a sound enhancing structure. In one end of tube is mounted an acoustic driver of the type shown and described in connection with FIG. 10. Please refer to the description of this figure for a description of this driver. Other types of drivers could be used, but use of this type of broadband driver with this structure is particularly advantageous. Unlike tube 90, tube 104 has an open end. The end of the tube is located approximately near the bottom surface of the magnet assembly 50. By mounting the driver in one end of tube 106, gap 108 between the magnet assembly 50 and the tube is formed. The dimensions of this passageway are generally characterized by a length L and a width D. This is not to imply, however, that these dimensions remain exact throughout the gap. These dimensions, as well as the general shape of the gap, can be selected based on a particular driver to "tune" that driver to achieve a desired frequency response. For example, if the dimensions of the driver's magnet or magnet assembly and the tube do not create a gap of the desired dimensions or shape, tube 104 could be changed and/or a structure may be added around the magnet assembly 50. Although not shown in these figures, the tube preferably has a sound absorbing inner surface, or a layer of sound absorbing material is placed over the surface.

Figure 14:
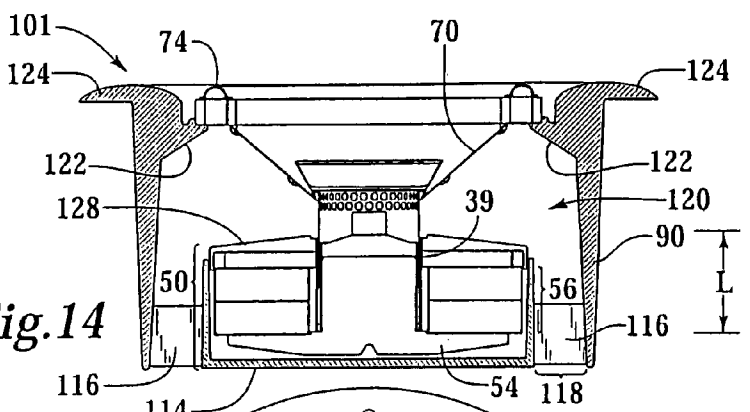
FIGS. 14 and 15 are respectively a front sectional and a bottom view of a loudspeaker assembly having an acoustic driver mounted in a second example of a sound enhancing structure.
Figure 15:
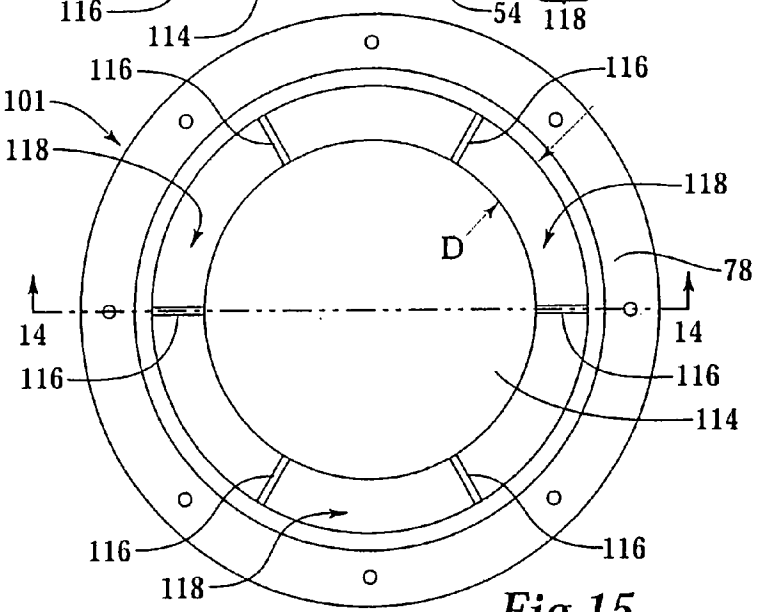
Figure 16:
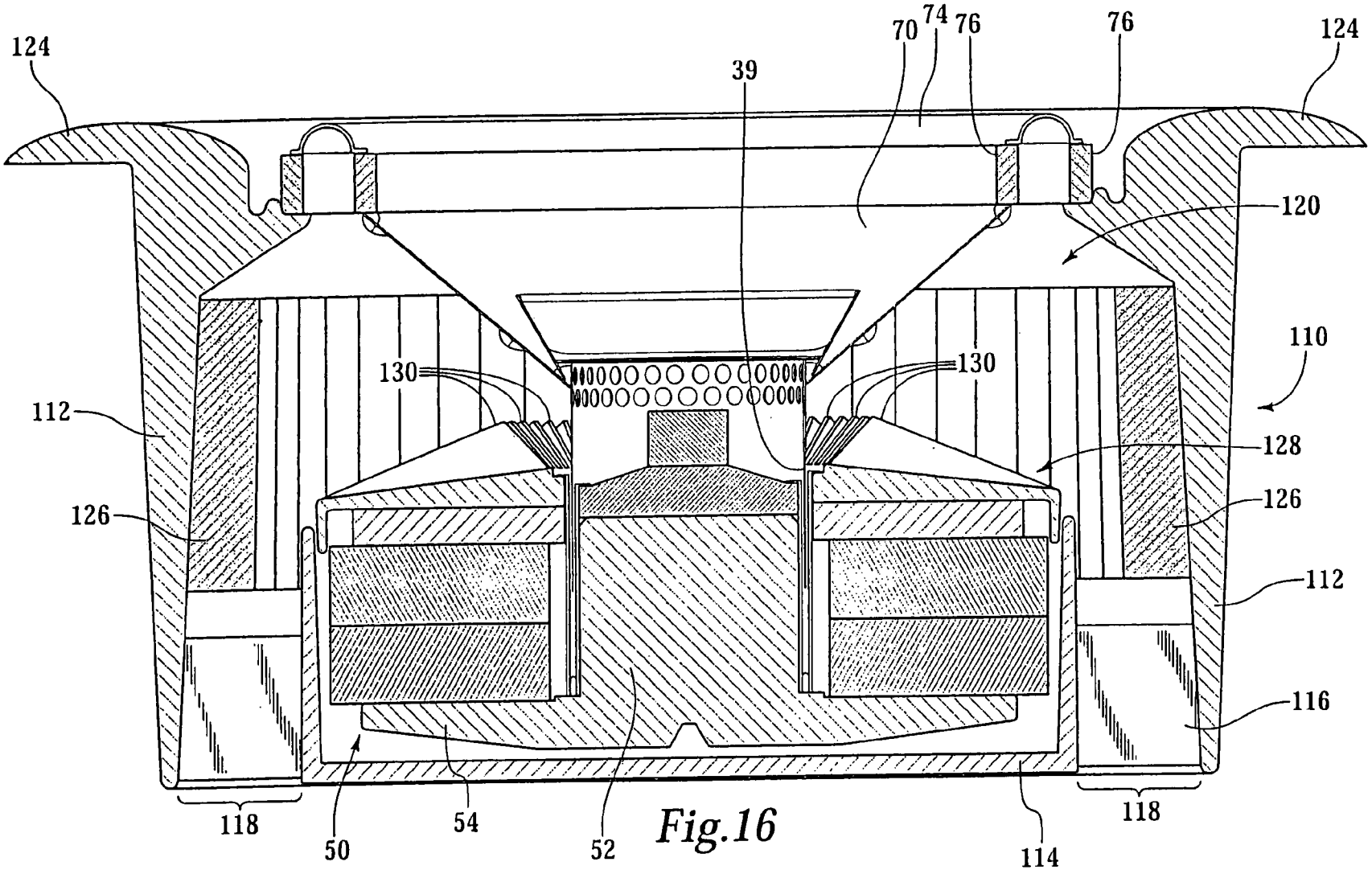
FIG. 16 is a front sectional view of the loudspeaker assembly of FIGS. 14 and 15, but with the addition of a sound absorbing lining.

FIGS. 14-16 illustrate a second exemplary embodiment of a loudspeaker assembly having a sound enhancing structure. It is described with reference to an acoustic driver of the type shown and described in FIG. 10. Please refer to the description of this figure for a description of the driver. Although the use in this assembly of this type of acoustic driver results in improved performance, and is thus particularly advantageous, other types of drivers could be used. The acoustic driver, which includes diaphragm 70 and a motor comprised of magnet assembly 50, is mounted in a front opening in one end of a monolithic sound enhancing structure 110 having a tubular portion 112 and a support portion 114. Tube 112 is similar to tube 104 of FIGS. 12 and 13, and performs a substantially similar function. Support portion 114 is centered at one end of, and attached to, the tube portion. This is done, in the illustrated example, by a plurality of elements 116 that span gap 118 between the support portion and the tube portion. These elements are symmetrically arranged in a radial pattern around the support element 114. To maximize the area of the opening of the gap, the elements have a relatively narrow profile. The narrow profile also tends to create less turbulence in air flow through the passageways.

Like gap 108 of FIGS. 12-13, gap 118 is generally characterized by a width D and length L. Elements 116 preferably also have length so that they, in effect, divide or segment the annular gap 118 into a plurality of elongated passageways. The dimensions and shape of elements 116 may be altered to create passageways having a desired shape and dimension, or a structure that achieves the desired sound enhancing effect. Alternately, they may be made to effectively create a single, annular shaped passageway. The support portion 114 preferably has a cup shape with a circular side wall that cooperates with the tube portion to define the length of gap 118. The dimensions and shape of gap 118, or passages established in part by or defined in place of the gap, can be selected based on the particular acoustic driver and desired performance. For example, altering the height, position, slant or orientation of the circular side wall of the support section 114 is possible, while still maintaining one or more passageways that couple volume 120 to the outside of the enclosure. The magnet assembly or motor of the acoustic driver is preferably adhered to an inner surface of the support portion 114 by any suitably thermally conductive mechanism, for example adhesive bonding, etc. The acoustic driver's suspension, which includes foam role 74 and riser elements 76, is attached on one side to lip 122 and on the other side to diaphragm 70. Therefore, unlike the example of FIGS. 12 and 13, this example of a sound enhancing structure does not require use of a separate basket structure to support the diaphragm and magnet assembly of an acoustic driver. Mounting flange 124 permits the speaker assembly to be mounted in a wall of enclosure. Sound enhancing structure 110 may be fabricated in separate pieces and joined, but is preferably made as a monolithic piece to reduce cost and time of assembly.

One limit on performance of loudspeakers created by the buildup of heat is due to resistance in an acoustic driver's voice coil. To facilitate transfer of heat, sound enhancing structure 110 is preferably made from a heat conducting material. Thus, heat will be conducted from magnet assembly 50 to support section 114, and then to support elements 116 and tube 112. The tube may radiate the heat into the air, as can also mounting flange 124. Furthermore, structure 110 is preferably relatively massive, as much as ten to forty times heavier than a conventional basket for an acoustic driver. The greater mass not only increases the thermal conductivity and thermal mass of the speaker, but it also decreases transmission of vibration to the wall in which the loudspeaker assembly is mounted. Less vibration improves clarity of sound reproduction. By casting it from, for example, aluminum (which is very conductive) or other metal, as a single piece, all of these benefits can be achieved. As shown only in FIG. 16, it is preferable to line at least a portion of an inside surface of tube 110 with a layer 126 of material, such as an adhesive-backed foam, that absorbs or dampens acoustic energy, particularly at mid to high frequencies. Furthermore, as best shown in FIG. 16, cap plate 128 of magnet assembly 50 is fitted with a plurality of fins 130 arranged in a radial pattern around the top of the magnet assembly for improving heat transfer away from the magnet assembly. The cap plate also has angled base surfaces that tend to reflect at least some of the incident acoustic energy away from the driver's diaphragm 70, preferably toward the side walls of sound enhancing structure.

The foregoing is but a description of exemplary embodiments of the invention, and is not intended to limit the invention to the specific examples shown and described, or to imply that all of the features and advantages of these examples must be found in the invention as it may be claimed.

What is claimed is:

1. A loudspeaker comprising:

a magnet assembly having a cylindrically-shaped flux gap;

a diaphragm suspended from a mounting;

a wire coil coupled to the diaphragm for moving the diaphragm in a reciprocating, linear fashion, the wire coil including a wire wound around a cylindrical base with spacing between adjacent windings of the wire substantially between seventy-five to one hundred fifty percent of the wire's diameter, the space between adjacent windings being devoid of any other conductive material.

2. The loudspeaker of claim 1, wherein the diaphragm is suspended from a non-sound-reflective basket.

3. The loudspeaker of claim 1, further comprising:

a perforated metal cover connected to the basked for protecting the diaphragm;

wherein the mounting is made of a heat conductive material and is in thermal communication with the magnet assembly for conducting heat generated by the coil to the cover.

4. The loudspeaker of claim 1, further comprising:

an inner and an outer thermally conductive, cylindrically-shaped metal sleeves disposed within the flux gap;

wherein the coil is disposed within the flux gap between the inner and outer sleeves, the sleeves remaining stationary relative to the magnet assembly during reciprocation of the coil within the flux gap.

5. The loudspeaker of claim 1, wherein the diaphragm is mounted to one end of a hollow, elongated structure and a relatively stiff plate mounted on a compliant suspension mounted to an end of the elongated structure opposite the of driver.

6. The loudspeaker of claim 1, wherein the diaphragm is mounted in an enclosure extending rearwardly from the diaphragm and terminating in an annular opening facing in a direction generally opposite of the acoustic driver.

7. The loudspeaker of claim 6, further including a basket and a perforated metal cover, the magnet assembly being mounted to the basket, with the diaphragm suspended from the basket and covered by the perforated metal cover, the magnet assembly, basket and perforated metal cover being in thermal communication.

8. The loudspeaker of claim 6, further comprising cooling fins in thermal communication with the outer thermally conducive, cylindrically-shaped metal sleeve.

9. The loudspeaker of claim 8, where the cooling fans are mounted to the magnet assembly, between the diaphragm and the magnet assembly.

10. The loudspeaker of claim 6, further including a substantially cylindrical enclosure having two ends, each with an opening, the diaphragm mounted in the opening of a first one of the two ends, the magnet assembly disposed within the cylindrical enclosure.

11. The loudspeaker of claim 10, wherein the magnet assembly and the cylindrical enclosure cooperate so that the opening at a second one of the two ends of the cylindrical enclosure, opposite the diaphragm, is generally annular.

12. The loudspeaker of claim 11, wherein a volume of space between the magnet assembly and the cylindrical enclosure is subdivided into a plurality of passageways that lead to the annular opening.

13. The loudspeaker of claim 1, wherein the wire has a substantially round cross-sectional shape.

14. The loudspeaker of claim 1, wherein the wire has a substantially rectangular cross-section, the diameter of the wire being equal to its width.

* * * * *